US006470503B1

(12) United States Patent
Holmes

(10) Patent No.: US 6,470,503 B1
(45) Date of Patent: Oct. 29, 2002

(54) FOOT OPERATED DEVICE FOR LIFTING A SEAT OF A TOILET

(76) Inventor: Mark F. Holmes, 2615-B Norris Ct., Philadelphia, PA (US) 19121

( * ) Notice: Subject to any disclaimer, the term of this patent is extended or adjusted under 35 U.S.C. 154(b) by 0 days.

(21) Appl. No.: 10/007,216

(22) Filed: Nov. 8, 2001

(51) Int. Cl.[7] ..... A47K 13/10
(52) U.S. Cl. ..... 4/246.1; 4/216.3
(58) Field of Search ..... 4/246.1, 246.3–246.5

(56) References Cited

U.S. PATENT DOCUMENTS

| | | | | | |
|---|---|---|---|---|---|
| 1,343,830 | A | * | 6/1920 | Kinch | 4/246.5 |
| 1,863,295 | A | * | 6/1932 | Bukovitz | 4/246.5 |
| 2,954,565 | A | * | 10/1960 | Miller | 4/246.5 |
| 3,504,385 | A | * | 4/1970 | Fields | 4/246.5 |
| 4,592,097 | A | * | 6/1986 | Zimmerman | 4/246.4 |
| 4,649,576 | A | | 3/1987 | Lillie | 4/251 |
| 4,862,525 | A | * | 9/1989 | Cheng | 4/246.5 |
| 4,975,988 | A | | 12/1990 | Won | 4/251 |
| 5,444,877 | A | | 8/1995 | Kumarasurier | 4/246.1 |
| 5,448,782 | A | * | 9/1995 | Ratajac | 4/246.5 |
| 5,487,192 | A | | 1/1996 | Hodges | 4/246.3 |
| 5,488,743 | A | | 2/1996 | Alfonso | 4/246.1 |
| 5,594,958 | A | | 1/1997 | Nguyen | 4/246.5 |
| 5,852,833 | A | * | 12/1998 | Gregoire | 4/246.3 |
| 5,857,223 | A | * | 1/1999 | Ferdinand | 4/246.1 |
| 6,151,723 | A | * | 11/2000 | MacAllister | 4/246.1 |

FOREIGN PATENT DOCUMENTS

| | | | | |
|---|---|---|---|---|
| DE | 342296 | * | 10/1921 | 4/246.4 |

* cited by examiner

*Primary Examiner*—Charles R. Eloshway
(74) *Attorney, Agent, or Firm*—Richard L. Miller, P.E.

(57) ABSTRACT

A foot operated device for lifting a toilet seat that includes a base, a foot pedal, a pair of arms, and a pedal lock. The base includes a pair of fulcrums. The foot pedal includes a pair of levers that are pivotally mounted to the pair of fulcrums, respectively, and a pedal that connects the pair of levers. The pair of arms are pivotally mounted to the levers, respectively, extend upwardly therefrom, and engage the toilet seat so as to allow the toilet seat to be raised when the pedal is depressed by a foot by virtue of the pair of levers being pivoted upwardly causing the pair of arms to rise and raise the toilet seat along therewith. The pedal lock is movably mounted to the base and maintains the toilet seat in its up position, and when released, allows the toilet seat to return to its down position.

7 Claims, 3 Drawing Sheets

FIG. 1
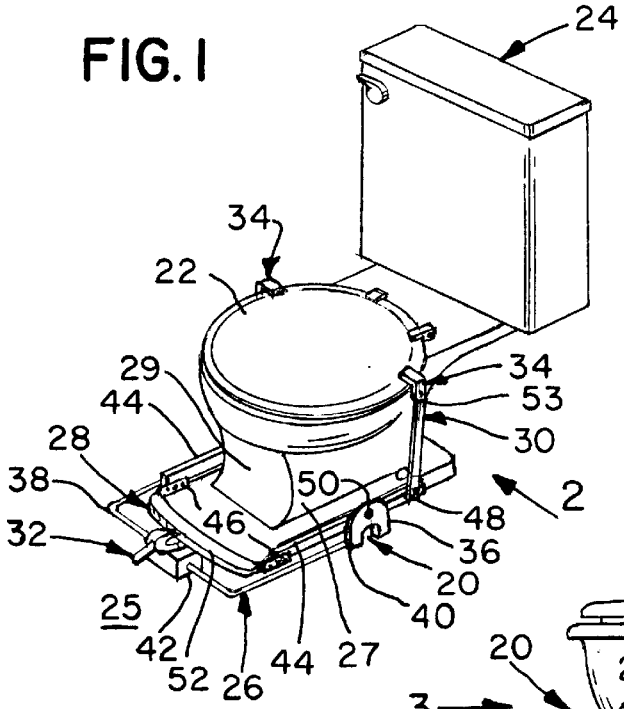
FIG. 2
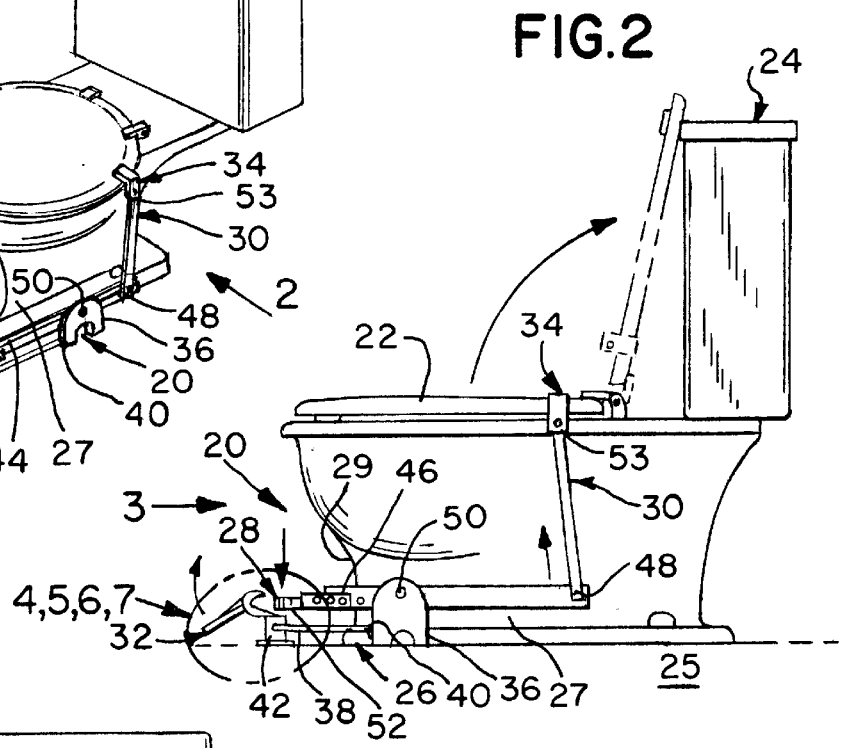
FIG. 3
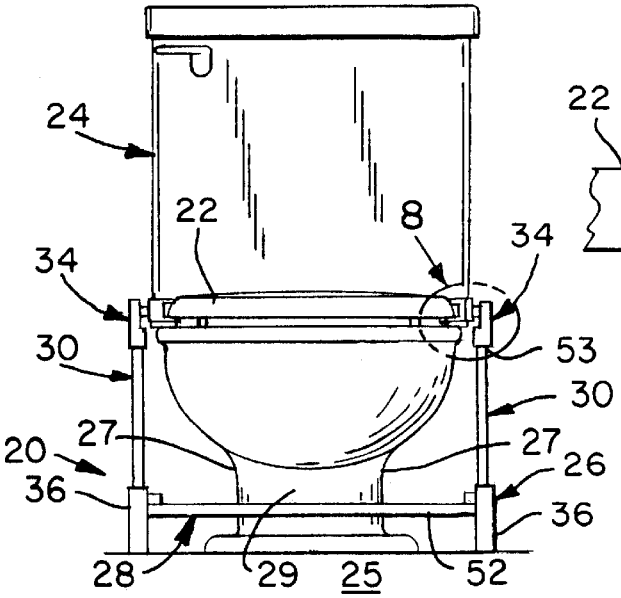
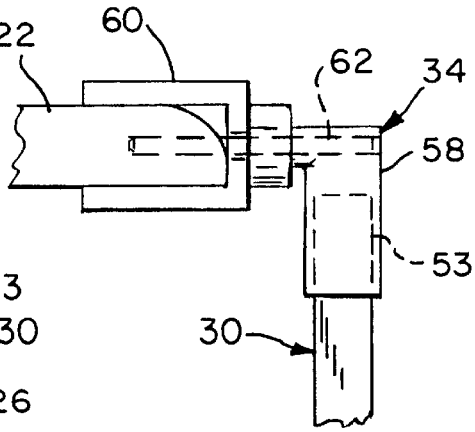
FIG. 8

FOOT OPERATED DEVICE FOR LIFTING A SEAT OF A TOILET

BACKGROUND OF THE INVENTION

1. Field of the Invention

The present invention relates to a device for lifting a seat of a toilet. More particularly, the present invention relates to a foot operated device for lifting a seat of a toilet.

2. Description of the Prior Art

Numerous innovations for foot operated devices for lifting a seat of a toilet have been provided in the prior art that will be described. Even though these innovations may be suitable for the specific individual purposes to which they address, however, they differ from the present invention.

A FIRST EXAMPLE, U.S. Pat. No. 4,649,576 to Lillie teaches a foot actuated toilet seat lifter in which a base member of substantially triangular cross-section is placed on the floor with the apex down. Foot pressure on one surface of the base pivots the base about the apex, causing a shaft to press upward on a bracket attached to the toilet seat, thus lifting the seat. A variety of base shapes are disclosed, together with a bellows for damping seat lowering, and optional means for securing the base to the floor or carpet. All parts are removable to aid in cleaning, and may be installed or removed without tools. The base member may optionally have a continuously curving lower surface, or may be formed of angled material to achieve the same effect as a triangular member. The resulting devices have the advantage of employing very few parts when compared to some prior art lifters.

A SECOND EXAMPLE, U.S. Pat. No. 4,975,988 to Won teaches a device for lifting, lowering, and locking a toilet seat assembly in position without any hands-on interaction with the toilet seat assembly that includes a selection of devices having additional mechanical advantage when pivoting the seat assembly. In one preferred embodiment of the invention, a cable-operated foot lever is used in combination with a crank portion on the hinge of the toilet seat. In another preferred embodiment of the invention, a system of planetary gears is used in the lever and/or the hinge assembly.

A THIRD EXAMPLE, U.S. Pat. No. 5,444,877 to Kumarasurier teaches a foot operated double acting lever for rotating a lid hinged to a base from a first position to a second position such as lifting the seat of a toilet bowl without touching the seat with the hands wherein the lid (or seat) is locked in the second position when the pedal is not depressed thereby maintaining the seat in its second position and is unlocked by depressing the pedal a second time and allowing the lid to rotate back to its first position at a speed that is under control of the foot on the pedal. The device includes a rotating housing coupled to one end of the lever (opposite the end with the pedal) that is coupled to a drive gear that turns a hinge gear mounted to rotate on the same axis as the lid. In order that the lid be locked in the second position, a lock catch engages the drive gear and a fixed slot thereby locking the drive gear. when the pedal is depressed, the lock catch is with drawn permitting the drive gear to rotate thereby allowing the lid to rotate on its hinge back to its first position.

A FOURTH EXAMPLE, U.S. Pat. No. 5,448,782 to RataJac teaches a foot actuated toilet seat lifting device having an adjustable width toilet seat attachment bracket, a telescoping lifting arm assembly, an actuator lever, a fluid pressure cylinder, and a base assembly. The rear end of the fluid pressure cylinder is pivotally secured to the base assembly and the front end of its piston rod is pivotally secured to the actuator lever intermediate its front and rear ends. The actuator lever is secured to a transversely extending axle mounted to the base assembly. A foot pedal assembly is mounted on the front end of the actuator level. When the foot pedal is depressed, the actuator level pivots around its axle and lifts the telescoping lifting arm assembly tube upwardly. This causes the toilet seat attachment bracket secured to its upper end to lift the toilet seat through a predetermined upward angle. The fluid pressure cylinder allows the toilet seat to be automatically slowly lowered to its horizontal position upon release of pressure on the foot pedal assembly.

A FIFTH EXAMPLE, U.S. Pat. No. 5,487,192 to Hodges teaches an apparatus for the raising and self-lowering of a toilet seat comprising a level, the lever being disposed in an essentially vertical plane having a central aperture extending therethrough for the receipt of a bolt and an associated nut for constituting a pivot point, the lever having an outboard end with a pedal secured thereto for being depressed by the foot of a user, the lever having an inboard end with an aperture therethrough for receipt of a bolt with an associated nut for transferring motion from the pedal to a toilet seat to be lifted upon the depression of the pedal; and a support assembly for attachment to a support bolt of a toilet seat and for supporting the lever at its pivot point, the support assembly including an L-shaped bracket with a horizontal leg formed with an aperture for being received by and secured to the support bolt of a toilet and with the L-shaped bracket having an upstanding leg with an aperture, the support assembly also having a horizontal bracket with a pair of apertures at each end, the aperture at one end being coupled to the apertures of the L-shaped bracket, the support assembly also including a vertical bracket having an upper end with two apertures adapted to be received in the outboard apertures of the horizontal bracket and with a lower end positionable in contact with the toilet for maintaining a proper orientation of the support assembly.

A SIXTH EXAMPLE, U.S. Pat. No. 5,488,743 to Alfonso teaches a mechanical apparatus used to lift and lower the lid and seat of a toilet by the way of a pedal mechanism. The pedal mechanism is connected by levers to a cylindrical lifting device mounted on a shaft. The lifting device is connected to the lid and seat by clasps which are screwed, bolted, riveted, or glued to the toilet lid and seat. The apparatus is held in place by floor braces attached by threaded studs which are fixed to the floor by nuts or by being cemented in depending on the material to be fixed to. An adjusting lever proceeding from the lifting device and connected to the pedal mechanism by a lever, can be adjusted 80 that the lid and seat stay up after taking the foot away from the pedal. One or both pedals can be actioned at the same time with one foot. The pedal stirrups are cup shaped. Thus the lid and seat can be lifted by pressing down with the sole of the shoe. To lower the seat and/or lid, the top of the shoe toe makes contact with the inside top of the pedal stirrup pressing upwards on the pedal thus lowering the seat and/or the lid. The entire apparatus can be made of synthetic materials and/or noncorrosive metal with the exception of the mounting shaft and the floor braces. For the mounting shaft and the floor braces noncorrosive metal is best due to the strain produced when fixing the apparatus in it place to keep it secured.

A SEVENTH EXAMPLE, U.S. Pat. No. 5,594,958 to Nguyen teaches a hands-off toilet seat lifting apparatus comprised of a mounting bracket adapted for removable securement around a base of an existing toilet. The mounting bracket has a securement block secured to an outer surface thereof. The device contains a first foot pedal having a rod extending outwardly therefrom. The rod has an end portion pivotally coupled to an intermediate portion of an arm. A stop mechanism is coupled around the pivotally coupled rod and arm. The arm has a first end and a second end. The first end is pivotally coupled to an outer surface of the securement block of the mounting bracket. The second end of the arm has an adjustable shaft extending upwardly therefrom. The adjustable shaft has an end portion secured to a toilet cover. The first foot pedal has a spring secured to a bottom surface thereof. The first end of the arm has a spring secured to a bottom surface thereof. It is apparent that numerous innovations for foot operated devices for lifting a seat of a toilet have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a foot operated device for lifting a seat of a toilet that avoids the disadvantages of the prior art.

ANOTHER OBJECT of the present invention is to provide a foot operated device for lifting a seat of a toilet that is simple and inexpensive to manufacture.

STILL ANOTHER OBJECT of the present invention is to provide a foot operated device for lifting a seat of a toilet that is simple to use.

BRIEFLY STATED, STILL YET ANOTHER OBJECT of the present invention is to provide a foot operated device for lifting a toilet seat that includes a base, a foot pedal, a pair of arms, and a pedal lock. The base includes a pair of fulcrums. The foot pedal includes a pair of levers that are pivotally mounted to the pair of fulcrums, respectively, and a pedal that connects the pair of levers. The pair of arms are pivotally mounted to the levers, respectively, extend upwardly therefrom, and engage the toilet seat so as to allow the toilet seat to be raised when the pedal is depressed by a foot by virtue of the pair of levers being pivoted upwardly causing the pair of arms to rise and raise the toilet seat along therewith. The pedal lock is movably mounted to the base and maintains the toilet seat in its up position, and when released, allows the toilet seat to return to its down position.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows:

FIG. 1 is a diagrammatic perspective view of the present invention installed on the seat of a toilet;

FIG. 2 is an enlarged diagrammatic side elevational view taken generally in the direction of arrow 2 in FIG. 1;

FIG. 3 is a diagrammatic front elevational view taken generally in the direction of arrow 3 in FIG. 2;

FIG. 8 is an enlarged diagrammatic side elevational view of the area generally enclosed by the dotted curve identified by arrow 8 in FIG. 3 of a first embodiment of the toilet seat attaching apparatus of the present invention;

LIST OF REFERENCE NUMERALS UTILIZED IN THE DRAWING

Figure 4:
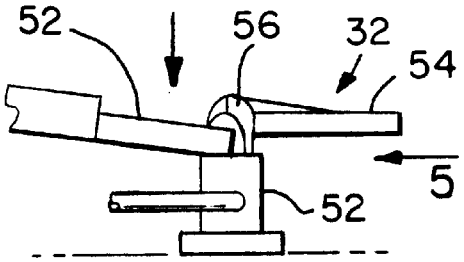
FIG. 4 is an enlarged diagrammatic side elevational view of the area generally enclosed by the dotted curve identified by arrow 4 in FIG. 2 of the pedal lock of the present invention in the locked position maintaining the toilet seat up.
Figure 6:
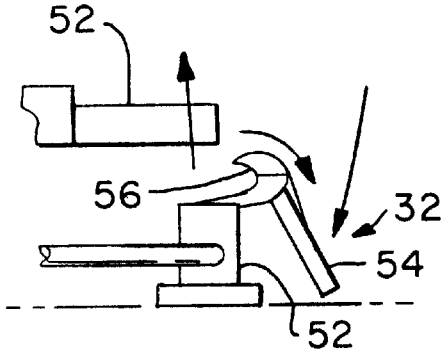
FIG. 6 is a diagrammatic side elevational view of the area generally enclosed by the dotted curve identified by arrow 6 in FIG. 2 of the pedal lock of the present invention released allowing the seat of the toilet to return down.
Figure 5:
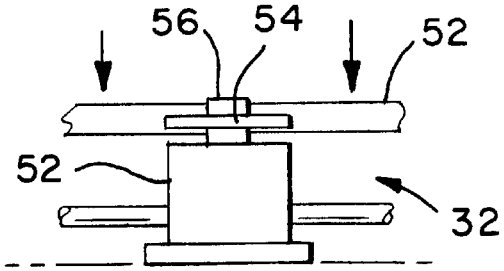
FIG. 5 is a diagrammatic front elevational view taken generally in the direction of arrow 5 in FIG. 4.
Figure 7:
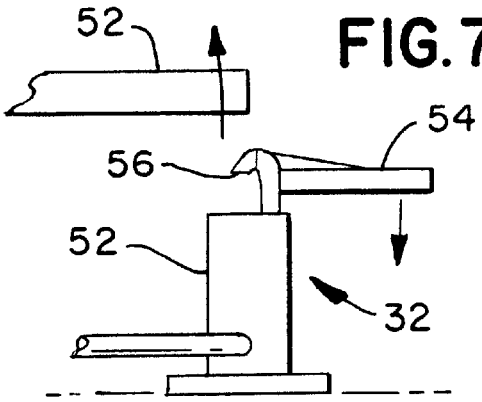
FIG. 7 is a diagrammatic side elevational view of the area generally enclosed by the dotted curve identified by arrow 7 in FIG. 2 of the pedal lock of the present invention released allowing the seat of the toilet to return down.

20 foot operated device of present invention for lifting seat 22 of toilet 24
22 seat of toilet 24
24 toilet resting on floor 25
25 floor
26 base for resting on floor 25 and straddling toilet 14
27 sides of toilet 24
28 foot pedal
29 front of toilet 24
30 pair of arms for attaching to seat 22 of toilet 24
32 pedal lock for maintaining seat 22 of toilet 24 in up position thereof, and when released, allows seat 22 of toilet 24 to return to down position thereof
34 apparatus for attaching pair of arms 30 to seat 22 of toilet 24
36 pair of fulcrums of base 26 for resting on floor 25 and straddling sides 27 of toilet 24
38 brace of base 26 for receiving front 29 of toilet 24
40 ends of brace 38 of base 26
42 block of base 26 for positioning at front 29 of toilet 24.
44 pair of levers of foot pedal 28 for straddling sides 27 of toilet 24
46 forwardmost end of each lever of pair of levers of foot pedal 28
48 rearwardmost end of each lever of pair of levers of foot pedal 28
50intermediate point of each lever of pair of levers of foot pedal 28
52 pedal of foot pedal 28 for positioning at front 29 of toilet 24
53 pair of uppermost ends of pair of arms 30, respectively
54 handle of pedal lock 32
56 fork of pedal lock 32

First Embodiment of Apparatus 34

58 pair of couplings of apparatus 34

60 pair of forks of apparatus 34 for snugly receiving seat 22 of toilet 24

62 pair of pivot pins of apparatus 34

Second Embodiment of Apparatus 134

130 pair of arms

134 apparatus

153 pair of uppermost ends of pair of arms 130, respectively

158 pair of couplings of apparatus 134

164 plurality of throughbores through pair of couplings 158, respectively, of apparatus 134

166 plurality of throughbores through pair of uppermost ends 153 of pair of arms 130, respectively, of apparatus 134

168 screws of apparatus 134

DESCRIPTION OF THE PREFERRED EMBODIMENT

Referring now to the figures, in which like numerals indicate like parts, and particularly to FIGS. 1–3, the foot operated device of the present invention is shown generally at 20 for lifting a seat 22 of a toilet 24, wherein the seat 22 of the toilet 24 has an up position and a down position, and wherein the toilet 24 rests on a floor 25 and has sides 27 and a front 29.

The foot operated device 20 comprises a base 26 for resting on the floor 25 and straddling the toilet 14, a foot pedal 28 that is pivotally mounted to the base 26, a pair of arms 30 that are pivotally mounted to the foot pedal 28 and are for attaching to the seat 22 of the toilet 24, a pedal lock 32 that is movably mounted to the base 26 and is for maintaining the seat 22 of the toilet 24 in the up position thereof, and when released, allows the seat 22 of the toilet 24 to return to the down position thereof, and apparatus 34 for attaching the pair of arms 30 to the seat 22 of the toilet 24.

The base 26 comprises a pair of fulcrums 36 that are inverted U-shaped and are for resting on the floor 25 and straddling the sides 27 of the toilet 24.

The base 26 further comprises a brace 38 that is U-shaped, has ends 40 that engage the pair of fulcrums 36, respectively, and is for receiving the front 29 of the toilet 24, and a block 42 that is for positioning at the front 29 of the toilet 24.

The foot pedal 28 comprises a pair of levers 44 that are pivotally mounted to the pair of fulcrums 36, respectively, and are for straddling the sides 27 of the toilet 24.

Each lever 44 has a forwardmost end 46, a rearwardmost end 48, and an intermediate point 50 that is intermediate the forwardmost end 46 thereof and rearwardmost end 48 thereof and is pivotally mounted to a respective fulcrum 36.

The foot pedal 28 further comprises a pedal 52 that extends from the forwardmost end 46 of one lever 44 to the forwardmost end 46 of the other lever 44 and is for positioning at the front 29 of the toilet 24.

The pair of arms 30 are pivotally mounted to the rearwardmost ends 48 of the pair of levers 44, respectively, extend upwardly therefrom to a pair of uppermost ends 53, respectively, and are for engaging the seat 22 of the toilet 24 so as to allow the seat 22 of the toilet 24 to be raised when the pedal 52 is depressed by a foot by virtue of the pair of levers 44 being pivoted upwardly causing the pair of arms 30 to rise and raise the seat 22 of the toilet 24 along therewith.

The specific configuration of the pedal lock 32 can best be seen in FIGS. 4–7, and as such, will be discussed with reference thereto.

The pedal lock 32 is movably mounted to the block 42 and has a handle 54 and a fork 56 that extends from the handle 54 thereof and which selectively engages the pedal 52, and when engaged, maintains the seat 22 of the toilet 24 in the up position thereof, and when disengaged by a foot depressing the handle 54, the seat 22 of the toilet 24 is allowed to return to the down position thereof.

The specific configuration of a first embodiment of the apparatus 34 can best be seen in FIG. 8, and as such, will be discussed with reference thereto.

The apparatus 34 comprises a pair of couplings 58 that telescopically receive the pair of uppermost ends 53 of the pair of arms 30, respectively.

The apparatus 34 further comprises a pair of forks 60 that extend inwardly from, and are pivotally mounted to, the pair of couplings 58, respectively, and are for snugly receiving the seat 22 of the toilet 24.

Figure 9:
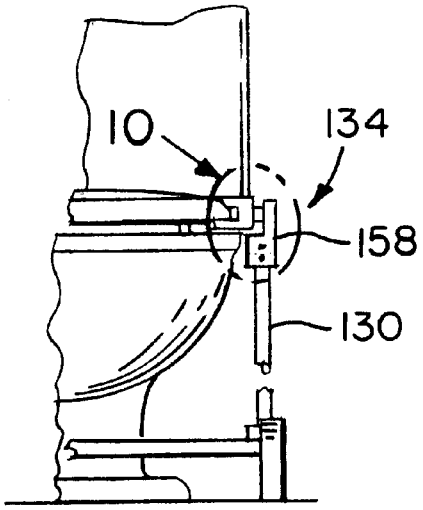
FIG. 9 is a diagrammatic front elevational view of the present invention installed on the seat of a toilet by a second embodiment of the toilet seat attaching apparatus of the present invention.
Figure 11:
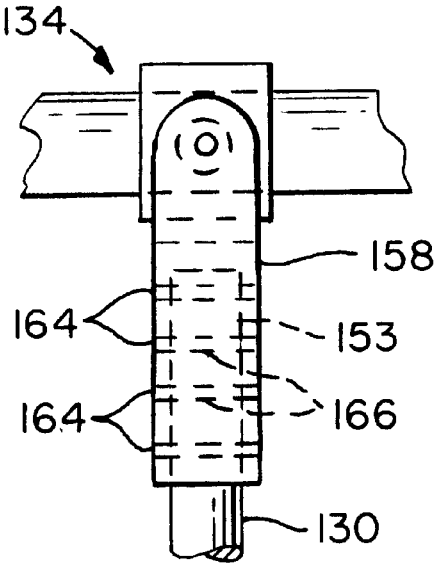
FIG. 11 is a diagrammatic side elevational view taken generally in the direction of arrow 11 in FIG. 10.
Figure 10:
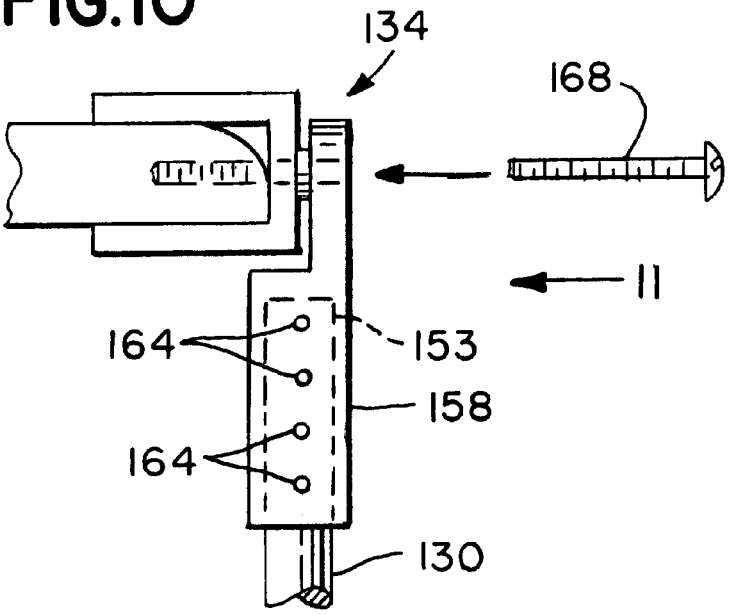
FIG. 10 is an enlarged diagrammatic side elevational view of the area generally enclosed by the dotted curve identified by arrow 10 in FIG. 9 of the second embodiment of the toilet seat attaching apparatus of the present invention.

The apparatus 34 further comprises a pair of pivot pins 62 that extend into the pair of couplings 58, respectively, through the pair of forks 60, respectively, and into the seat 22 of the toilet 24.

the specific configuration of a second embodiment of the apparatus 134 can best be seen in FIGS. 9–11, and as such, will be discussed with reference thereto.

The apparatus 134 is similar to the apparatus 34, except:

1. The pair of couplings 158 have a plurality of throughbores 164, respectively, that extend transversely therethrough and are spaced longitudinally therealong.
2. The pair of uppermost ends 153 of the pair of arms 130 have a plurality of throughbores 166, respectively, that extend transversely therethrough, are spaced longitudinally therealong, and are alignable with the plurality of throughbores 164 in the pair of couplings 158, respectively, so as to allow at least one fastener to extend into at least one throughbore 164 in each coupling 158 and into an aligned throughbore 166 in the uppermost end 153 of an associated arm 130 so as to allow the pair of arms 130 to be height adjustable.
3. The pair of pivot pins 62 are screws 168 for threadably engaging into the seat 22 of the toilet 24.

It will be understood that each of the elements described above, or two or more together, may also find a useful application in other types of constructions differing from the types described above.

While the invention has been illustrated and described as embodied in a foot operated device for lifting a seat of a toilet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A foot operated device for lifting a seat of a toilet, wherein the seat of the toilet has an up position and a down position, and wherein the toilet rests on a floor and has sides and a front, said device comprising:

a) a base;

a) a foot pedal;

c) a pair of arms;

d) a pedal lock; and e) means for attaching said pair of arms to the seat of the toilet;

wherein said base is for resting on the floor;

wherein said base is for straddling the toilet;

wherein said foot pedal is pivotally mounted to said base;

wherein said pair of arms are pivotally mounted to said foot pedal;

wherein said pair of arms are for attaching to the seat of the toilet;

wherein said pedal lock is movably mounted to said base; and wherein said pedal lock is for maintaining the seat of the toilet in the up position thereof, and when released, allows the seat of the toilet to return to the down position thereof, wherein said base comprises a pair of fulcrums;

wherein said pair of fulcrums are inverted U-shaped;

wherein said pair of fulcrums are for resting on the floor; and wherein said pair of fulcrums are for straddling the sides of the toilet, wherein said base comprises a brace;

wherein said brace is U-shaped;

wherein said brace has ends;

wherein said ends of said brace engage said pair of fulcrums, respectively;

wherein said brace is for receiving the front of the toilet;

wherein said brace comprises a block; and wherein said block is for positioning at the front of the toilet.

2. A foot operated device for lifting a seat of a toilet, wherein the seat of the toilet has an up position and a down position, and wherein the toilet rests on a floor and has sides and a front, said device comprising:

a) a base;

a) a foot pedal;

c) a pair of arms;

d) a pedal look; and e) means for attaching said pair of arms to the seat of the toilet;

wherein said base is for resting on the floor;

wherein said base is for straddling the toilet;

wherein said foot pedal is pivotally mounted to said base;

wherein said pair of arms are pivotally mounted to said foot pedal;

wherein said pair of arms are for attaching to the seat of the toilet;

wherein said pedal lock is movably mounted to said base; and wherein said pedal lock is for maintaining the seat of the toilet in the up position thereof, and when released, allows the seat of the toilet to return to the down position thereof, wherein said base comprises a pair of fulcrums;

wherein said pair of fulcrums are inverted U-shaped;

wherein said pair of fulcrums are for resting on the floor; and wherein said pair of fulcrums are for straddling the sides of the toilet, wherein said foot pedal comprises a pair of levers;

wherein said pair of levers are pivotally mounted to said pair of fulcrums, respectively; and wherein said pair of levers are for straddling the sides of the toilet, wherein each lever has a forwardmost end;

wherein each lever has a rearwardmost end;

wherein each lever has an intermediate point;

wherein said intermediate point of each lever is intermediate said forwardmost end thereof and said rearwardmost end thereof; and wherein said intermediate point of each lever is pivotally mounted to a respective fulcrum, wherein said foot pedal comprises a pedal;

wherein said pedal extends from said forwardmost end of one lever to said forwardmost end of the other lever; and wherein said pedal is for positioning at the front of the toilet, wherein said pedal lock is movably mounted to a block;

wherein said pedal lock has a handle;

wherein said pedal lock has a fork;

wherein said fork extends from said handle of said pedal lock; and wherein said fork selectively engages said pedal, and when engaged, maintains the seat of the toilet in the up position thereof, and when disengaged by a foot depressing said handle, the seat of the toilet is allowed to return to the down position thereof.

3. A foot operated device for lifting a seat of a toilet, wherein the seat of the toilet has an up position and a down position, and wherein the toilet rests on a floor and has sides and a front, said device comprising:

a) a base;

a) a foot pedal;

c) a pair of arms;

d) a pedal lock; and e) means for attaching said pair of arms to the seat of the toilet;

wherein said base is for resting on the floor;

wherein said base is for straddling the toilet;

wherein said foot pedal is pivotally mounted to said base;

wherein said pair of arms are pivotally mounted to said foot pedal;

wherein said pair of arms are for attaching to the seat of the toilet;

wherein said pedal lock is movably mounted to said base; and wherein said pedal lock is for maintaining the seat of the toilet in the up position thereof, and when released, allows the seat of the toilet to return to the down position thereof, wherein said base comprises a pair of fulcrums;

wherein said pair of fulcrums are inverted U-shaped;

wherein said pair of fulcrums are for resting on the floor; and wherein said pair of fulcrums are for straddling the sides of the toilet, wherein said foot pedal comprises a pair of levers;

wherein said pair of levers are pivotally mounted to said pair of fulcrums, respectively; and wherein said pair of levers are for straddling the sides of the toilet, wherein each lever has a forwardmost end;

wherein each lever has a rearwardmost end;

wherein each lever has an intermediate point;

wherein said intermediate point of each lever is intermediate said forwardmost end thereof and said rearwardmost end thereof; and wherein said intermediate point of each lever is pivotally mounted to a respective fulcrum, wherein said foot pedal comprises a pedal;

wherein said pedal extends from said forwardmost end of one lever to said forwardmost end of the other lever; and wherein said pedal is for positioning at the front of the toilet, wherein said pair of arms are pivotally mounted to said rearwardmost ends of said pair of levers, respectively;

wherein said pair of arms extend upwardly from said rearwardmost ends of said pair of levers, respectively, to a pair of uppermost ends, respectively; and wherein said pair of arms are for engaging the seat of the toilet so as to allow the seat of the toilet to be raised when said pedal is depressed by a foot by virtue of said pair of levers being pivoted upwardly causing said pair of arms to rise and raise the seat of the toilet along therewith, wherein said means includes a pair of couplings; and wherein said pair of couplings telescopically receive said pair of uppermost ends of said pair of arms, respectively, wherein said means includes a pair of forks;

wherein said pair of forks extend inwardly from said pair of couplings, respectively;

wherein said pair of forks are pivotally mounted to said pair of couplings, respectively; and wherein said pair of forks are for snugly receiving the seat of the toilet.

4. The device as defined in claim 3, wherein said means includes a pair of pivot pins; and wherein said pair of pivot pins extend into said pair of couplings, respectively, through said pair of forks, respectively, and into the seat of the toilet.

5. The device as defined in claim 4, wherein said means includes said pair of pivot pins being screws; and wherein said screws are for threadably engaging into the seat of the toilet.

6. The device as defined in claim 3, wherein said means includes said pair of couplings having a plurality of throughbores, respectively;

wherein said plurality of throughbores in said pair of couplings extend transversely therethrough; and wherein said plurality of throughbores in said pair of couplings are spaced longitudinally therealong.

7. The device as defined in claim 6, wherein said means includes said pair of uppermost ends of said pair of arms having a plurality of throughbores, respectively;

wherein said plurality of throughbores in said uppermost ends of said pair of arms extend transversely therethrough;

wherein said plurality of throughbores in said uppermost ends of said pair of arms are spaced longitudinally therealong; and wherein said plurality of throughbores in said uppermost ends of said pair of arms are alignable with said plurality of throughbores in said pair of couplings, respectively, so as to allow at least one fastener to extend into at least one throughbore in each coupling and into an aligned throughbore in said uppermost end of an associated arm so as to allow said pair of arms to be height adjustable.

* * * * *